United States Patent [19]

Dietrich

[11] Patent Number: 4,471,179

[45] Date of Patent: Sep. 11, 1984

[54] MAGNETIC SNAP SWITCH

[75] Inventor: Bernhard Dietrich, Eichenau, Fed. Rep. of Germany

[73] Assignee: SDS Elektro GmbH, Deisenhofen, Fed. Rep. of Germany

[21] Appl. No.: 442,872

[22] Filed: Nov. 19, 1982

[30] Foreign Application Priority Data

Nov. 20, 1981 [DE] Fed. Rep. of Germany ..... 3146069

[51] Int. Cl.[3] ..... H01H 5/02

[52] U.S. Cl. ..... 200/67 F; 335/188

[58] Field of Search ..... 200/67 F, 67 R, 67 PK; 335/188, 207

[56] References Cited

U.S. PATENT DOCUMENTS 2,410,055 10/1946 Frerer ..... 200/67 F

FOREIGN PATENT DOCUMENTS 0214430 12/1956 Australia ..... 200/67 F

*Primary Examiner*—Stephen Marcus
*Assistant Examiner*—Ernest G. Cusick
*Attorney, Agent, or Firm*—Murray Schaffer

[57] ABSTRACT

A quick-break snap switch having an activating plunger which, when depressed, establishes an operative connection with a return spring and causes the charging of a spring force accumulator. A ferromagnetic anchor is mounted pivotable about an axis running at right angles to the direction of the plunger activation. The anchor forms the jump member and is a component of a magnetic clamp arrangement containing a permanent magnet. The anchor activates at least one movable contact. The jumping action is initiated in both switching directions by the creation of an air gap between the anchor and its respective abutting surface in the magnet clamp. The magnetic clamp arrangement contains at least one yoke by means of which a magnetic circuit is closed in both positions of the anchor.

14 Claims, 2 Drawing Figures

MAGNETIC SNAP SWITCH

BACKGROUND OF THE INVENTION

The present invention relates to an electrical quick-break or snap switch comprising an activating plunger which, when depressed, establishes an operative connection with a return spring, and charges a spring force accumulator coupled to an anchor tiltable about an axis running at right angles to the direction of plunger activation. The anchor forms the jump member of a magnetic clamp arrangement containing a permanent magnet and having two switching positions. The movement of the anchor activating at least one movable electric contact. An additional spring force accumulator is provided for the return of the anchor to its initial position and the action of the anchor is initiated in each switching directions by the creation of an air gap between the armature and the respective abutting surface of the magnetic clamp.

Quick-break switches having a jumping member which is activated merely by a spring have the disadvantage that the contact force in the immediate proximity of the jumping point becomes almost zero. This disadvantage does not occur with quick-break switches in which the jumping member is a component of a magnetic clamp arrangement. There is known, for instance, magnetic clamp arrangements having two permanent magnets firmly attached to the housing, and an adhesion plate (German examined patent spec. No. 1 118 315 and German printed publ. of unexamined patent spec. No. 1 911 104); with a permanent magnet fixed to the housing and two adhesion plates (German patent spec. No. 24 45 957 and German printed publ. of unexamined patent specification No. 26 57 231) connected with the jumping member; as well as two adhesion plates fixed to the housing and a permanent magnet connected with the jumping member (German patent spec. No. 1 190 088). In all these known quick-break switches the jumping member executes a rectilinear displacement along the axis of the activating plunger, ergo in the direction of activation. Furthermore, the necessary springs, in particular the return and force accumulation springs are arranged in or at least along the same axis, so that these switches have a great structural length or depth.

Only the switch cited at the outset deviates from this principle of construction. There, an anchor, mounted tiltable about an axis running at right angles to the activating direction of the plunger, is used as a jumping member. This anchor, operatively connected with the plunger by way of an activating nose, carries at each of its two ends a resilient electrical contact member. The anchor cooperates with a rod-shaped permanent magnet arranged in parallel to the activating plunger so that it abuts in each of the two switching positions on one or the other half of a bar magnet, executing a tilting movement about a bearing edge supported in the center of the bar magnet for the purpose of changing the switching position. Considerable flux leakage is generated in this design of the magnetic clamp arrangement. The attractive force of the permanent magnet is thus only utilized inadequately and a relatively large bar magnet is necessary with a specified contact force. Since the pull-off force required for the separation of the anchor from the bar magnet is subjected to considerable spread between units, a relatively great activating force is required, taking into account in addition the tolerances of the various springs still to be added.

An object of the present invention is to produce a quick-break switch of the type cited at the outset, which has a small structural volume and requires a relatively small activating force despite high contact forces.

SUMMARY OF THE INVENTION

This task is solved pursuant to the invention by providing the magnetic clamp arrangement with at least one yoke, by means of which the magnetic circuit is closed in both positions of the anchor.

In this way, flux leakage is prevented and the attractive forces of the permanent magnet are utilized optimally, making it possible to employ an especially small permanent magnet, resulting not only in a small structural depth but overall in a switch of small size.

It is preferred that the yoke be C-shaped.

An advantageous embodiment of the quick-break switch is obtained when the anchor, formed of ferromagnetic material, is provided in vertical cross-section in the shape of an H; and is privotally mounted about the transverse axis through its center bar, so that, depending on the respective switching position, the one or the other of the ends of its longitudinal arms, which face each other diametrically in relation to the rotational axis of the anchor, abut on the ends of the yoke.

Although the permanent magnet may in principle also be arranged rigidly in the housing, i.e. be contained in the yoke, it is nevertheless envisioned that the permanent magnet has the form the transverse bar of the anchor so as to preserve the production-technical advantage of a one-piece yoke with a simultaneous space-saving arrangement of the permanent magnet.

In another embodiment the longitudinal axis of the anchor may run at right angles to the displacement direction of the activating plunger when the anchor is in the center position.

A space-saving structural design of the quick-break switch lies also in the fact that the anchor is capable of being activated by means of a rocker mounted to pivot about an axis running parallel to the rotational axis of the anchor, said rocker in turn being operatively connected with the activating plunger when the latter is depressed.

An additional embodiment of the switch is distinguished by the fact that the rocker tensions the return spring with one of its arms when the activating plunger is depressed. The return spring can therefore, in order to save space, be arranged in parallel to the direction of action of the activating plunger.

A contributing factor to the attainment of a compact structural shape lies in the fact that the spring force accumulators may be combined with the rocker to be activated thereby.

The spring force accumulators are preferable formed from a single leaf spring resiliently held by the rocker and arranged essentially parallel to the longitudinal axis of the anchor.

The leaf spring can brace itself for this purpose at the center in the area of the rotational axis of the rocker, and each of its ends resting in a recess formed at the respective end of the rocker. The recesses may be provided with a free path for the spring permitting the tensioning and tension-releasing movement required to activate and de-activate the spring force accumulators thus attained. The free path may be limited by two stops.

To the extent that an approximately centric position is desired for the activating plunger in relation to the switch housing, the plunger may be biased with a compensating leaf spring mounted approximately in parallel with the rocker. This leaf spring may be attached with its one end to the switch housing and bracing with its other end, in the end of the rocker counteracting the return spring.

The quick-break switch described can be designed in particular as a double circuit change-over contact with two separate contact bridges for the break and make contact. For this purpose, a movable contact is operatively connected with each of the two ends of the longitudinal arms of the anchor on the surface facing away from the activating plunger.

It is preferable to design each of the two movable contacts as a contact arm, one end of which is formed as a knife-edge contact resting constantly on a fixed contact and the other end connected with at least one additional fixed contact as a break or make contact, or change-over contact respectively. In this case an adjustment of the movable contact arm is unnecessary. Furthermore, the largest possible contact opening path is always obtained. In addition, the requirement frequently existing also with a double-circuit change-over contact, by which the break and make contact should perform their switching action without overlapping, can also be easily fulfilled. Finally, the fact that with the use of contact arms the contact force may be generated by a spring carrying no current. This has the advantage of being able to select the contact force at random within a wide range.

In the drawing, the quick-break switch pursuant to the invention is illustrated in an embodiment selected by way of example.

DESCRIPTION OF THE INVENTION

Figure 1:
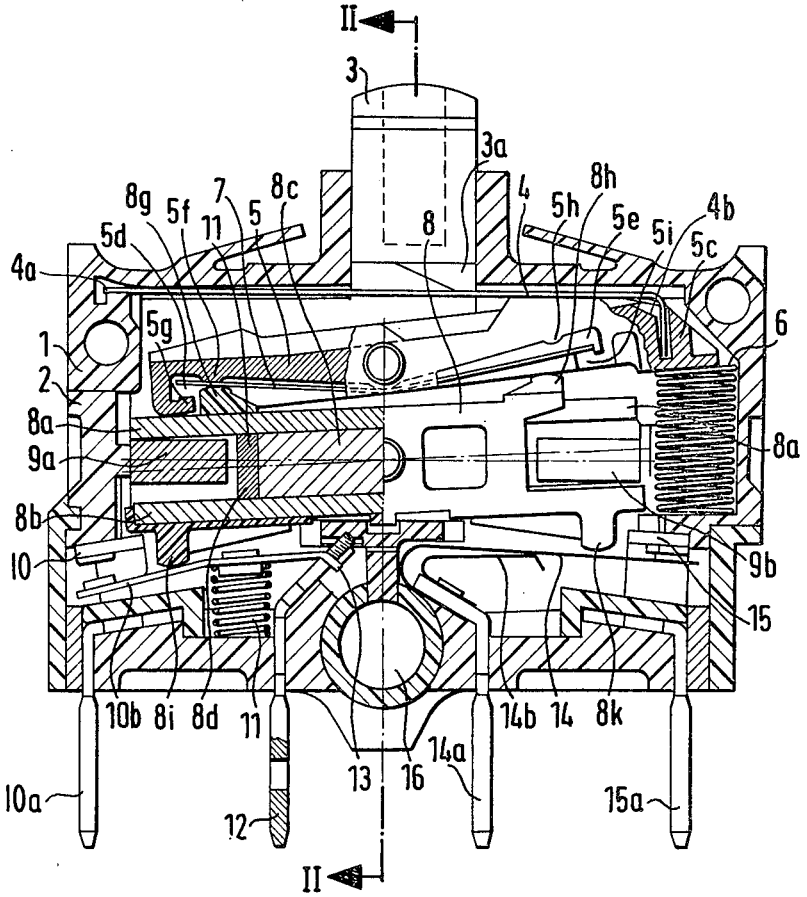
FIG. 1 is a sectional view (with parts in full view) of the switch of the present invention taken along the line I—I of FIG. 2.
Figure 2:
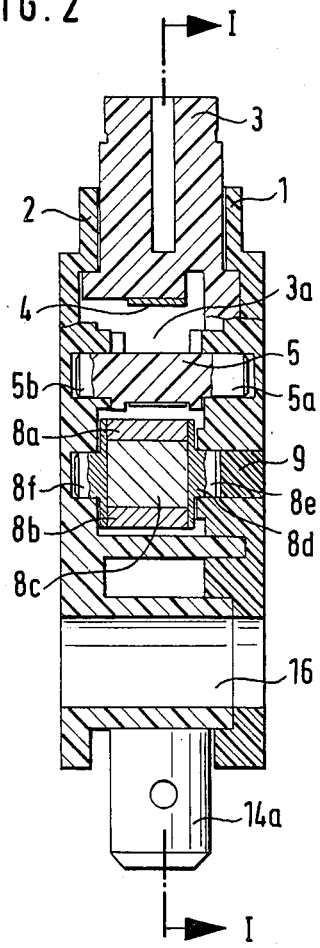
FIG. 2 is a sectional view taken along the line II—II in FIG. 1.

As seen in the drawings, the quick-break or snap switch of the present invention consists of a housing formed of a base 1 and a lid 2 engaging each other and partially fitted with teeth for the purpose of enabling adjustment of the air and leakage paths. An activating plunger 3 extends into the interior of the housing and is provided with an eccentric activating nose 3*a*, by means of which it rests on a horizontal compensating leaf spring 4. The left end 4*a* of the spring 4 is accommodated, as shown in FIG. 1, in a recess in the housing, while its free right end 4*b* is angled downward in a recess formed in a rocker 5 so that the right half of this compensating leaf spring 4 rests on the right arm of the rocker 5. As shown in FIG. 2, the rocker 5 is journalled between the housing base 1 and the lid 2 by laterally extending pivot pins 5*a*, 5*b*. The right arm of the rocker has a projection 5*c* connected operatively to a return spring 6, the other end of the spring being braced against a shoulder formed in the interior of the housing.

Both arms of the rocker 5 have depending hook-shaped ends opening to form pockets 5*d* and 5*e* which accommodate the respective ends of a pretensioned leaf spring 7. The leaf spring 7 is braced in the center against the center of rocker 5 below its pivots 5*a*, 5*b* and biases each end of the rocker so as to form with each of the two arms of the rocker 5, a spring force accumulator. The pockets 5*d* and 5*e* respectively, are enlarged to provide a free path for the spring 7 for tensioning and tension-relieving movements. The movement is limited by stops 5*f* and 5*g*, as well as 5*h* and 5*i* respectively.

An anchor 8 having an H-shaped vertical cross-section is arranged below the rocker 5. The longitudinal arms 8*a* and 8*b* are made of ferromagnetic material while its transverse bar 8*c* separating the arms consists of a permanent magnet. The arms and bar are connected to each other by a plastic extrusion coating. The anchor 8 is formed with two pivot pins 8*e*, 8*f* integral with the bar 8*c* so that it may be journalled in the housing base 1 and the lid 2 (see FIG. 2). Two activating cams 8*g* and 8*h* are formed on the upper surface of the longitudinal arm 8*a* and two activating cams 8*i* and 8*k* are formed on the lower surface longitudinal arms 8*b*.

A C-shaped yoke 9, with its longside embedded in the housing base 1 is situated with its short legs 9*a* and 9*b* between the ends of the longitudinal arms 8*a*, 8*b* of the anchor 8. The legs 9*a* and 9*b* extending perpendicular to the plane of the drawing sheet of FIG. 1.

While activating cams 8*g* and 8*h* on the upper edge of the anchor 8 act jointly with a respective end of the leaf spring 7, the lower activating cams 8*i* and 8*k* serve as activators for the electrical contacts. In the embodiment shown by way of example the quick-break switch is illustrated as a double circuit changeover contact with separate contact points for the break and make contacts. For the sake of simplicity, FIG. 1 shows within the same switch two different embodiments for these contact points. The make contact on the left is comprised of a fixed contact 10 with its connecting plug 10*a*, as well as a movable contact 10*b* biased by a contact force spring 11 in the closing direction. The movable contact 10*b* is connected to its connecting plug 12 by means of a knife-edge contact 13. In contrast, the break contact shown on the right in the figure comprises a spring contact arm 14 with its connecting plug 14*a* and a supporting spring 14*b* acting together with a fixed contact 15 with its connecting plug 15*a*.

A through-bore 16 serves to accommodate a fastening screw (not shown) which holds the housing base and cover together.

The switch works as follows: With the arrangement of FIG. 1 taken as the initial or rest position, when the activating plunger 3 is depressed, the rocker 5 is turned clockwise by the nose 3*a*, which is to the right of the pivot axis of the rocker, and the compensating leaf spring 4 of the former. This compresses the return spring 6. At first, the right section of the leaf spring 7 comes to rest on the activating cam 8*h* of the anchor 8 and is lifted with progressive rotation of the rocker 5 off the stop 5*i*, while at the same time the left end of the leaf spring 7 is removed from the stop 5*f*. A direct operative connection between the rocker 5 and the anchor 8 occurs only when the right end of the leaf spring 7 comes to rest on the stop 5*h* and the first spring force accumulator formed by this leg is thus loaded. This direct operative connection causes, with further insertion of the activating plunger 3, the lifting of the lower longitudinal arm 8*b* of the anchor 8 from the right leg 9*b* of the yoke 9 and the upper longitudinal arm 8*a* from the left leg 9*a* of the yoke 9 contrary to the holding power of the permanent magnet 8*c*. With the enlargement of the two air gaps—one between the lower longitudinal arm 8*b* and the right leg 9*b*, the other between the upper longitudinal arm 8*a* and the left leg 9*a*—the holding power of the permanent magnet decreases rapidly. When an equilibrium is reached between the holding moments of the circuit of the permanent magnet and the force moment of the loaded spring force accumulator, the latter is unloaded and the right end of the leaf spring 7 imparts an acceleration to the anchor 8 in the direction of its new resting position, opposite to that shown in the drawings. This causes the movable contacts 10 and 14 to be brought suddenly from their resting position into their working position. After the release of the activating plunger 3, the return to the resting position occurs logically in the same way in the respective reversed direction.

The quick-break switch may be used as a limit switch according to VDE (Assn. of German Electrical Engineers) 0113, since a safe interruption of the circuit is obtained also when the contacts of the break are welded together and/or when all springs of the switch are ruptured such that a non-positive direct connection is then established between the activating plunger 3 and the anchor 8, this being accomplished especially also by the nose 3*a* of the activating plunger which is arranged eccentrically in relation to the axis of the rocker 5.

I claim:

1. A magnetic snap switch comprising a housing having mounted therein a plunger, a return spring biasing said plunger, and a magnetic jump mechanism coupled to a movable contact arm, a first spring force accumulator effective to move said jump mechanism, a second spring force accumulator effective to return said jump mechanism, said jump mechanism comprising a magnetic anchor of longitudinal H-shaped cross section having a pair of spaced parallel arms and a transverse bar; said anchor being pivotable about an axis extending through the transverse bar, the spaced arms of said anchor, providing a pair of abutment surfaces, and a fixed magnetic member fixed to said housing and disposed in part between the spaced arms of said anchor and forming a pair of abutment positions for said abutment surfaces, said anchor being actuated by operation of said plunger in cooperation with the spring force accumulators to jump from one surface to the other on creation of an air gap between the existing abutting surface.

2. The snap switch according to claim 1 wherein said fixed magnetic member is ferromagnetic and said anchor is permanently magnetic.

3. The snap switch according to claim 2 wherein the fixed magnetic member is C-shaped.

4. The snap switch according to claim 2 wherein the anchor is pivotably mounted at its center.

5. The snap switch according to claim 2 wherein a permanent magnet forms the transverse bar of said anchor, and the arms thereof are ferromagnetic.

6. The snap switch according to claim 2 wherein the longitudinal axis of the anchor runs in its center position at right angles to the displacement direction of the plunger.

7. The snap switch according to any one of the preceding claims wherein the anchor is activated by a rocker, said rocker being mounted tiltable about an axis running in parallel to the axis of the transverse bar of the anchor and is operatively connected with the plunger, said spring force accumulators being operatively connected with the respective ends of the longitudinal arms of the anchor.

8. The snap switch according to claim 7 including a return spring urged against one arm of said rocker to bias plunger.

9. The snap switch according to claim 8 wherein the spring force accumulators consist of a single leaf spring arranged substantial parallel to the longitudinal axis of the anchor and resilently held in the rocker.

10. The snap switch according to claim 9 wherein the center of leaf spring is braced against the axis of the rocker, and in that each of its ends rests in one recess at respective end of the rocker, said recess having a free path for the tensioning and tension releasing movement and stop means for limiting said path.

11. The snap switch according to claim 10 wherein the plunger is biased by a compensating leaf spring arranged substantially parallel to the rocker and fixed at one end to the housing and being braced with its other end against the return spring and the arm of the rocker tensioning the return spring.

12. The snap switch according to claim 9 including a movable contact operatively connected with each of the two ends of the arms of the anchor on the surface away from the plunger.

13. The snap switch according to claim 12 wherein the movable contact consists of a contact bridge one end of which is formed as a knife-edge contact resting permanently on a fixed contact and the other end in connection with at least one further fixed contact as a break or make contact, or a change-over contact.

14. The snap switch according to claim 12 whereby the movable contact is a leaf spring.

* * * * *